US005454744A

United States Patent [19]

Seiler

[11] Patent Number: 5,454,744

[45] Date of Patent: Oct. 3, 1995

[54] RAIN PANTS WITH LIFE SAVING DEVICE

[76] Inventor: Mark T. Seiler, 29 S. Prospect Ave., Patchogue, N.Y. 11772

[21] Appl. No.: 220,229

[22] Filed: Mar. 30, 1994

[51] Int. Cl.[6] ..... B63C 9/125; B63C 9/15

[52] U.S. Cl. ..... 441/109; 441/113; 2/69; 2/79; 2/82

[58] Field of Search ..... 441/88, 102, 103, 441/106, 108, 109, 111, 112, 122, 125, 96, 97, 113; 2/79, DIG. 3, 67, 69

[56] References Cited

U.S. PATENT DOCUMENTS

| | | | |
|---|---|---|---|
| 2,292,490 | 8/1942 | Stokes | 441/111 X |
| 3,154,800 | 11/1964 | Anderson | 441/111 X |
| 3,465,375 | 9/1969 | Schnell | 441/109 X |
| 3,682,354 | 8/1972 | Witte | 441/97 X |
| 3,890,662 | 6/1975 | Roberts | 441/96 |
| 4,687,451 | 8/1987 | Chen | 441/97 X |

*Primary Examiner*—Clifford D. Crowder
*Assistant Examiner*—Shirra L. Jenkins
*Attorney, Agent, or Firm*—Michael I. Kroll

[57] ABSTRACT

Rain pants with life saving device is provided which consists of waterproof overalls worn by a fisherman. A structure on the overalls extends about the chest of the fisherman, for buoying the fisherman in water to float in an upright position. A mechanism is for activating the buoying structure, so that the fisherman will float in the upright position in the water.

7 Claims, 2 Drawing Sheets

RAIN PANTS WITH LIFE SAVING DEVICE

BACKGROUND OF THE INVENTION

1. Field of the Invention

The instant invention relates generally to buoyant waterproof garments and more specifically it relates to rain pants with a life saving device.

2. Description of the Prior Art

Numerous buoyant waterproof garments have been provided in prior art. For example, U.S. Pat. Nos. 550,226 to Layman; 2,276,082 to Meyers; 2,292,490 to Stokes and 2,888,691 to Manning all are illustrative of such prior art. While these units may be suitable for the particular purpose to which they address, they would not be as suitable for the purposes of the present invention as heretofore described.

Layman, Hiram D.

LIFE PRESERVER

U.S. Pat. No. 550,226

A life preserver comprising a flexible water-tight pantaloons suit. A continuous tubular inflatable float body encircles the upper part of the suit and is disposed at an oblique angle to the length of the suit. Positive fastening means is for connecting the float body with the pantaloons suit and maintains the same relatively so disposed to each other.

Myers, Joe W.

BOOT BOAT

U.S. Pat. No. 2,276,082

A wading garment for use by fishermen includes leg and body encasing portions. Buoyant means is disposed adjacent the waist for supporting the wearer afloat. Propelling fins are attached to the outer sides of the leg portions of the garment. The fins each include an elongated flexible strip disposed longitudinally of a leg portion and has end portions secured thereto. The strips each have an unattached intermediate portion. The intermediate portion is flared toward its back edge and is flared outwardly relatively to the leg portion. The intermediate portion combines with the leg portion, with which it is associated, to form a rearwardly diverging rearwardly opening pocket.

Stokes, Charles L.

SPORT GARMENT

U.S. Pat. No. 2,292,490

An attachment for high waders comprising a waterproof sheet of material of generally cylindrical shape adapted to form an airtight chamber with a lower opening when fixed around the upper end of the waders and immersed. The sheet has an upper outwardly and downwardly flaring section joined to a lower outwardly and upwardly flaring section and is thus adapted to be distorted at its upper end into an enlarged annular chamber by entrapped air. Means at the lower end of the sheet is to restrict the entry and exit of air.

Manning, Glenn E.

BUOYANT GARMENT

U.S. Pat. No. 2,888,691

A buoyant garment comprising a trouser portion having separate leg and foot portions adapted to cover the legs and feet of the wearer. A body portion rising above the trouser portion and is adapted to encircle the body of the wearer. The body portion is adapted to terminate immediately below the arms of the wearer. The body portion has spaced inner and outer walls connected at their top and bottom and forms an enclosed annular air space between the walls adapted to encircle the body of the wearer and to extend from the top of the body portion downwardly at least to the waist of the wearer. Means is to inflate the air space. Dividers connect the inner and outer walls to divide the air space into separate compartments. Air duct means between the inner and outer walls near the bottom thereof bypass the dividers to provide communication between the compartments. The outer wall and the dividers are flexible to collapse and close the duct means when the air in the air space is compressed in the upper portion thereof by immersion of the garment in water.

SUMMARY OF THE INVENTION

A primary object of the present invention is to provide rain pants with life saving device that will overcome the shortcomings of the prior art devices.

Another object is to provide rain pants with life saving device in which waterproof overalls worn by a fisherman contains a buoyant segment that will maintain the fisherman afloat in an upright position in water when inflated.

An additional object is to provide rain pants with life saving device that will not hamper the freedom of movement of the fisherman while out of the water and the buoyant segment is deflated.

A further object is to provide rain pants with life saving device that is simple and easy to use.

A still further object is to provide rain pants with life saving device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
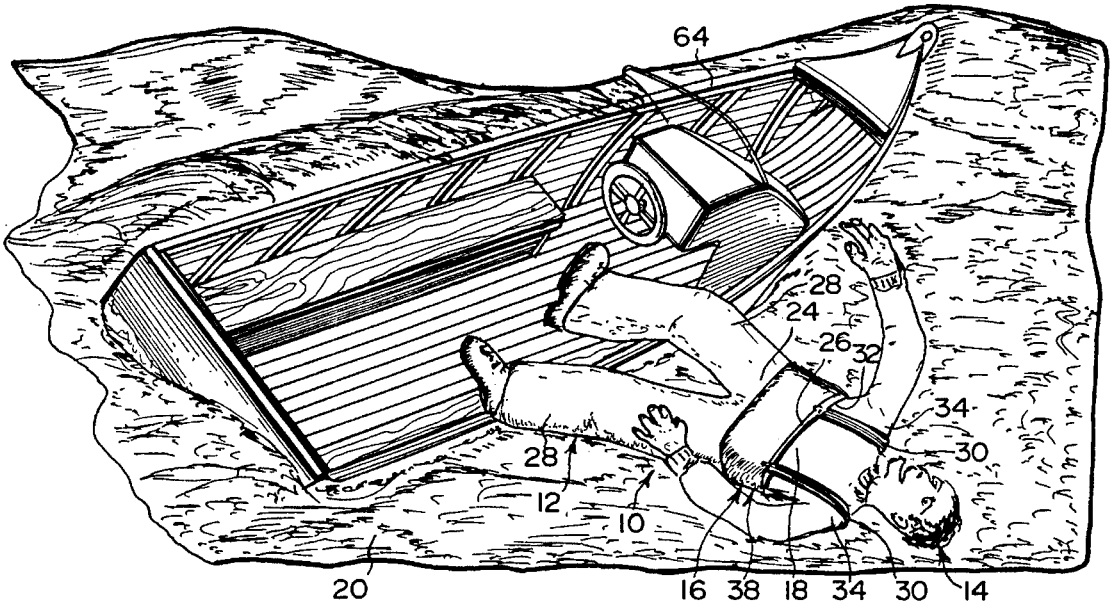
FIG. 1 is a perspective view showing a fisherman wearing the invention, falling out of a boat and into the water.
Figure 2:
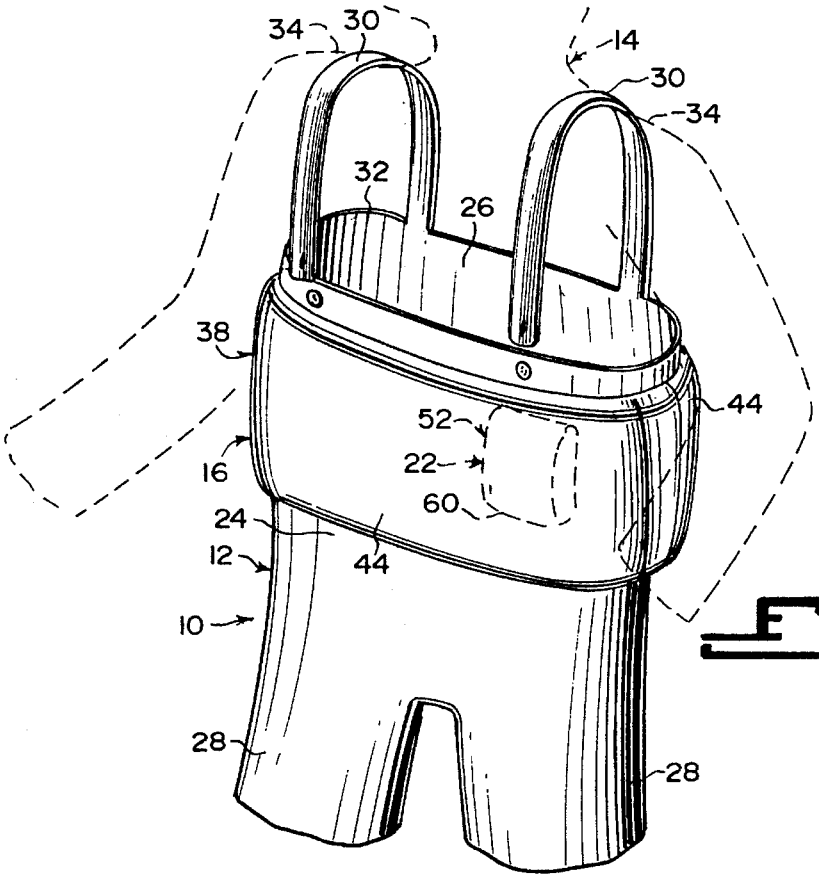
FIG. 2 is a perspective view of the instant invention with parts broken away before inflation of the inner tube.
Figure 3:
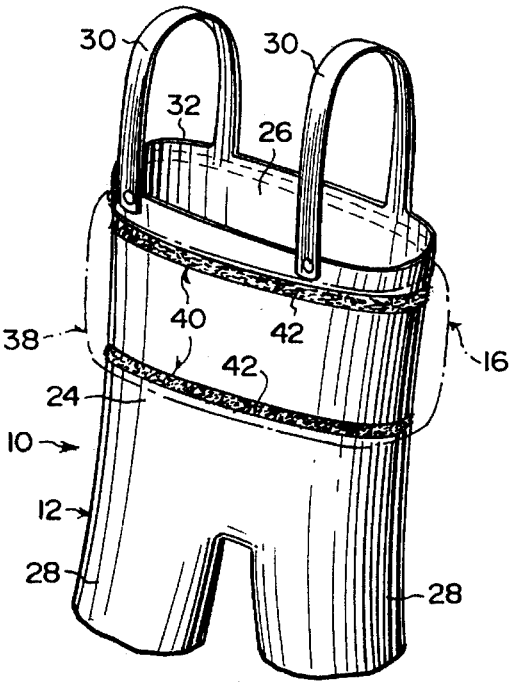
FIG. 3 is a perspective view similar to FIG. 2, of just the waterproof overalls.
Figure 4:
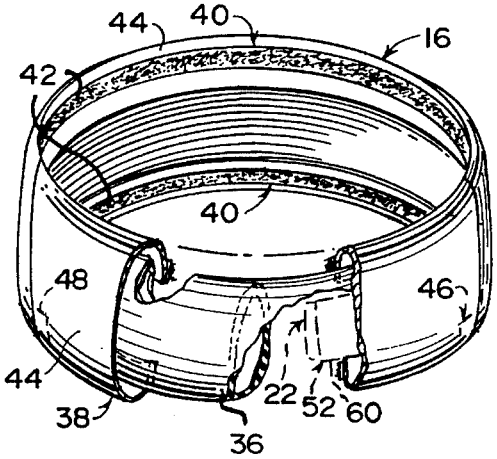
FIG. 4 is a perspective view with parts broken away showing the protective casing about the inner tube before inflation.

Turning now descriptively to the drawings, in which similar reference characters denote similar elements throughout the several views, FIGS. 1 through 6 illustrate rain paints with life saving device 10, consisting of waterproof overalls 12 worn by a fisherman 14. A structure 16 on the overalls 12 extends about the chest 18 of the fisherman 14, for buoying the fisherman 14 in water 20 to float in an upright position. A mechanism 22 is for activating the buoying structure 16, so that the fisherman 14 will float in the upright position in the water 20.

The waterproof overalls 12 include a body portion 24 adapted to encircle the lower torso of the fisherman 14. A bib portion 26 extends above the body portion 24 and is adapted to encircle the upper torso of the fisherman 14 below the armpits. A pair of leg portions 28 extend below the body portion 24 and are adapted to cover the legs of the fisherman 14. The waterproof overalls 12 further contain a pair of support straps 30, each attached to an upper open end of the bib portion 26 at the front and back, so as to pass over the shoulders 34 of the fisherman 14, to secure the waterproof overalls 12 in place.

The buoying structure 16 includes a circular inflatable inner tube 36 extending about the bib portion 26 of the waterproof overalls 12. An annular protective casing 38 covers the inner tube 36.

Components 40 are for removably attaching the casing 38 to the bib portion 26 of the waterproof overalls 12. The removably attaching components 40 are a plurality of mating hook and loop pile fastener material strips 42 between upper and lower edges of the casing 38 and the bib portion 26 of the waterproof overalls 12.

The casing 38 is divided into at least two segments 44. Elements 46 are for removably attaching the at least two segments 44 of the casing 38 together about the bib portion 26 of the waterproof overalls 12 and over the inner tube 36. The removably attaching elements 46 are a plurality of mating hook and loop pile fastener material tabs 48 between abutting side edges of the at least two segments 44 of the casing 38.

Figure 5:
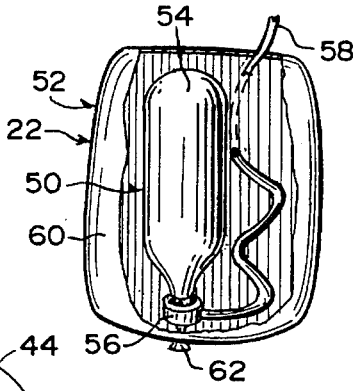
FIG. 5 is a perspective view of the inside pocket with parts broken away showing the water activated inflation mechanism therein.
Figure 6:
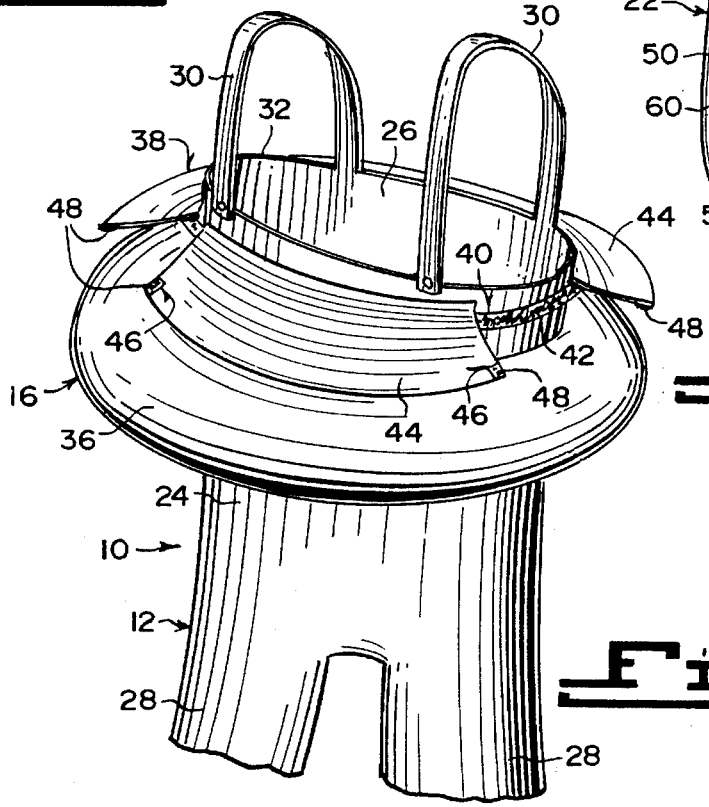
FIG. 6 is a perspective view similar to FIG. 2 after inflation of the inner tube is completed.

The activating mechanism, as best seen in FIG. 5, includes a unit 50 for automatically inflating the inner tube 36 when making contact with the water 20. A component 52 is for storing the inflating unit 50 on the bib portion 26 of the waterproof overalls 12. The inflating unit 50 consists of a CO2 cartridge 54. A water activated valve holder 56 is fluidly connected to the cartridge 54. An inflation hose 58 is fluidly connected between the valve holder 56 and the inner tube 36.

The storing compartment 52 is an inside pocket 60 connected to a front area on the bib portion 26 of the waterproof overalls 12. The inside pocket 60 can maintain the cartridge 54 and the valve holder 56 therein. A manually operated deflation release control knob 62 is fluidly connected to the valve holder 56, so that the fisherman 14 can deflate the inner tube 36, with the control knob 62 when removed from the water 20.

OPERATION OF THE INVENTION

To use the rain pants with life saving device 10, the following steps should be taken by the fisherman 14:

1. Step into the overalls 12.
2. Place the support straps 30 over the shoulders 34.
3. When accidentally falling into the water 20, such as from a boat 64 as shown in FIG. 1, the inflating unit 50 will automatically be operated by the water activated valve holder 56.
4. The inner tube 36 will then inflate causing the segments 44 of the casing 38 to open.
5. The inner tube 36 will keep the fisherman 14 in an upright vertical position in the water 20 to prevent drowning.
6. When out of the water 20, the deflation release control knob 62 is manually pulled to deflate the inner tube 36, so that the fisherman 14 can freely move about to perform his tasks.

LIST OF REFERENCE NUMBERS

10 rain pants with life saving device
12 waterproof overalls
14 fisherman
16 buoying structure
18 chest of 14
20 water
22 activating mechanism
24 body portion of 12
26 bib portion of 12
28 leg portion of 12
30 support strap
32 upper open end of 26
34 shoulder of 14
36 circular inflatable inner tube
38 protective casing
40 removably attaching components
42 mating hook and loop pile fastener material strips for 40
44 segment of 38
46 removably attaching elements
48 mating hook and loop pile fastener material tabs for 46
50 inflating unit
52 storing component
54 CO2 cartridge
56 water activated valve holder
58 inflation hose
60 inside pocket for 52
62 deflation release control knob It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. Rain pants with life saving device comprising:

a) waterproof overalls worn by a fisherman comprising a body portion adapted to encircle the lower torso of the fisherman, a bib portion extending above said body portion and adapted to encircle the upper torso of the fisherman below the armpits, and a pair of leg portions extending below said body portion and adapted to cover the legs of the fisherman;

b) means on said overalls comprising an inflatable inner tube extending about said bib portion encircling said fisherman, said tube being normally collapsed but upon inflation buoying the fisherman in water to float in an upright position;

c) means for activating said buoying means to inflate said inner tube when said fisherman is immersed in water, so that the fisherman will float in the upright position in the water; and d) annular protective casing means covering said inner tube when collapsed, said casing being removably attached to said bib portion under said tube both over the top of said tube and under a bottom of said tube, said casing means being divided into sections removably attached to each other so that said casing sections are lifted from said bib portion and from each other as said inner tube is inflated.

2. Rain pants with life saving device as recited in claim 1, wherein said waterproof overalls further includes a pair of support straps each attached to an upper open end of said bib portion at the front and back, so as to pass over the shoulders of the fisherman to secure said waterproof overalls in place.

3. Rain pants with life saving device as recited in claim 3 wherein said casing sections are attached to each other and to said bib portion by a plurality of mating hook and loop pile fastener material strips between upper and lower edges of said casing means and said bib portion of said waterproof overalls and overlapping sections of said casing means.

4. Rain pants with life saving device as recited in claim 3, wherein said activating means includes:

a) means for automatically inflating said inner tube when making contact with the water; and b) means for storing said inflating means on said bib portion of said waterproof overalls.

5. Rain pants with life saving device as recited in claim 4, wherein said inflating means includes:

a) a CO2 cartridge;

b) a water activated valve holder fluidly connected to said cartridge; and c) an inflation hose fluidly connected between said valve holder and said inner tube.

6. Rain pants with life saving device as recited in claim 5, wherein said storing means is an inside pocket connected to a front area on said bib portion of said waterproof overalls, so that said inside pocket can maintain said cartridge and said valve holder therein.

7. Rain pants with life saving device as recited in claim 6, further including a manually operated deflation release control knob fluidly connected to said valve holder, so that the fisherman can deflate said inner tube with said control knob when removed from the water.

* * * * *